US005248375A

United States Patent [19]

Steiniger

[11] Patent Number: 5,248,375

[45] Date of Patent: Sep. 28, 1993

[54] APPARATUS FOR APPLYING ADHESIVE TO WEBS TO WRAPPING MATERIAL IN TOBACCO PROCESSING MACHINES

[75] Inventor: Wolfgang Steiniger, Börnsen, Fed. Rep. of Germany

[73] Assignee: Körber AG, Hamburg, Fed. Rep. of Germany

[21] Appl. No.: 872,829

[22] Filed: Apr. 23, 1992

[30] Foreign Application Priority Data

Apr. 30, 1991 [DE] Fed. Rep. of Germany ..... 4114070

[51] Int. Cl.[5] ..... B05C 1/08

[52] U.S. Cl. ..... 156/461; 118/216; 118/220; 118/221; 118/244; 118/255; 118/258; 131/37; 131/69; 156/578

[58] Field of Search ..... 156/461, 465, 466, 200, 156/211, 259, 578, 201, 203; 131/35, 37, 60, 67, 69, 73, 84.1, 105; 118/216, 220, 221, 225, 244, 255, 256, 258, 259; 493/276, 277, 278, 279, 285, 286

[56] References Cited

U.S. PATENT DOCUMENTS

| | | | |
|---|---|---|---|
| 1,248,314 | 11/1917 | Grahl | 131/69 |
| 3,400,007 | 9/1968 | Rudszinat | 156/466 |
| 4,889,138 | 12/1989 | Heitmann et al. | 131/84.1 |
| 4,893,640 | 1/1990 | Heitmann et al. | 131/84.4 |
| 4,917,118 | 4/1990 | Mangiarotti | 131/84.1 |
| 4,924,885 | 5/1990 | Heitmann et al. | 131/84.4 |
| 4,945,926 | 8/1990 | Mattei et al. | 131/84.1 |

FOREIGN PATENT DOCUMENTS 1238845 7/1971 United Kingdom .

*Primary Examiner*—Michael W. Ball
*Assistant Examiner*—Richard Crispino
*Attorney, Agent, or Firm*—Peter K. Kontler

[57] ABSTRACT

Two parallel webs of wrapping material are advanced toward the inlet of a wrapping mechanism in a twin cigarette rod making, filter rod making or like machine adjacent a paster with two wheel-shaped rotary applicators which apply strips of adhesive to selected marginal portions of the respective webs. The applicators receive adhesive from discrete rotary adhesive supplying members which, in turn, receive adhesive from a tandem pump. The applicators are installed at a level below the wrapping mechanism to reduce the likelihood of contamination of such mechanism by sprays or droplets of adhesive. The webs are draped around discrete tobacco-containing or filter material-containing rods, and the adhesive-coated marginal portions of the webs are folded over the other marginal portions to form seams which extend in parallelism with the axes of the resulting cigarette rods or filter rods.

10 Claims, 2 Drawing Sheets

APPARATUS FOR APPLYING ADHESIVE TO WEBS TO WRAPPING MATERIAL IN TOBACCO PROCESSING MACHINES

BACKGROUND OF THE INVENTION

The invention relates to improvements in apparatus for applying adhesive to running webs of paper or the like, and more particularly to improvements in apparatus (often called pasters) which are used in cigarette rod making, filter rod making and like machines to supply adhesive to running webs of cigarette paper, imitation cork, tipping paper and the like. Apparatus of such character are used in machines for the making of rod-shaped smokers' products and serve to apply adhesive to one marginal portion of a web so that the one marginal portion can be folded over and adheres to the other marginal portion of the same web when the latter is draped around a rod of fibrous material, such as natural, reconstituted and/or substitute tobacco or filter material for tobacco smoke.

In many heretofore known pasters, the element which applies adhesive to one marginal portion of a running web of cigarette paper or the like is a roller or wheel. Such rollers or wheels are preferred for the application of a pasty starch-containing adhesive. As a rule, the marginal portion of a web, which is about to be coated with adhesive, projects tangentially of the advancing tobacco rod or filter rod which is already draped into the remaining (major) portion of the web. The freshly coated marginal portion is then folded over the other marginal portion to form therewith a customary seam which extends in parallelism with the axis of the thus obtained cigarette rod, filter rod or another rod which is ready to be subjected to the action of a cutoff so as to yield a file of plain cigarettes, cigarillos, cigars, cheroots or filter rod sections of unit length or multiple unit length.

Problems arise in machines which are designed to simultaneously produce several rod-like smokers' products, for example, in so-called twin cigarette rod making machines which turn out two continuous cigarette rods. The space in such machines is at a premium and two discrete pasters, one for each cigarette rod, occupy a substantial amount of space.

OBJECTS OF THE INVENTION

An object of the invention is to provide a novel and improved adhesive applying apparatus which is simpler and more compact than heretofore known apparatus.

Another object of the invention is to provide a novel and improved paster for use in cigarette rod making, filter rod making and analogous machines of the tobacco processing industry.

A further object of the invention is to provide a paster which can be installed in existing cigarette rod making and other rod making machines to occupy space which is readily available in such machines.

An additional object of the invention is to provide an adhesive applying apparatus which is less likely to contaminate the surrounding area than heretofore known apparatus.

Still another object of the invention is to provide a paster which can be utilized with advantage in machines for turning out plural continuous rod-shaped products of the tobacco processing industry.

A further object of the invention is to provide a machine which embodies an adhesive applying apparatus of the above outlined character.

An additional object of the invention is to provide the above outlined apparatus with novel and improved assemblies of means for transferring adhesive from one or more sources to one or more running webs of wrapping material in a machine of the above outlined character.

Another object of the invention is to provide a novel and improved method of installing an adhesive applying apparatus in a rod making machine, particularly in a machine for making plural tobacco-containing or filter material-containing rods.

Still another object of the invention is to provide a method of reducing the likelihood of contamination of the wrapping mechanism or mechanisms in a machine for making filter rods, cigarette rods and analogous rod-shaped products of the tobacco processing industry.

An additional object of the invention is to provide a production line with two or more filter rod making or tobacco rod making machines which are equipped with the above outlined adhesive applying apparatus.

SUMMARY OF THE INVENTION

The invention resides in the provision of an apparatus for applying adhesive to web-like wrapping material in a machine wherein a wrapping mechanism includes means for draping wrapping material around at least one rod-shaped product of the tobacco processing industry. The improved apparatus comprises means for advancing wrapping material in the form of at least one web along a predetermined path toward the wrapping mechanism, a source of adhesive, and means for transferring adhesive from the source to wrapping material in a predetermined portion of the path. The transferring means includes a plurality of rotaty adhesive transferring elements. The predetermnned portion of the path is adjacent the wrapping mechanism, and the at least one web is substantially tangential to one of the transferring elements.

The rotary adhesive transferring elements can include two disc-shaped applicators which contact two spaced-apart portions of wrapping material in the predetermined portion of the path.

The apparatus can be used to apply adhesive to a single web of wrapping material; the two applicators then contact two spaced-apart parallel portions at one side of the single web. Alternatively, the apparatus can be used to apply adhesive to two parallel webs of wrapping material; each applicator then contacts one of the two parallel webs. Each of the two webs has a first marginal portion adjacent the other web and a second marginal portion which is remote from the other web. The arrangement can be such that one of the applicators contacts the first marginal portion of the respective web and the other applicator contacts the second marginal portion of the respective web. The two webs are preferably coplanar in the predetermined portion of the path, and each such web is substantially tangential to the respective applicator.

The aforementioned rotary elements preferably further comprise a discrete rotary adhesive supplying member for each of the applicators, and means for feeding adhesive from the source to the two adhesive supplying members. The feeding means can comprise a tandem pump.

The applicators are preferably coaxial, and the two adhesive supplying members can be disposed at opposite sides of the common axis of the applicators.

The apparatus can further comprise means for rotating the adhesive supplying members, and such rotating means can comprise a common drive for the adhesive supplying members.

The apparatus can further comprise means for rotating the coaxial applicators, and such rotating means can comprise a common drive for the applicators.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
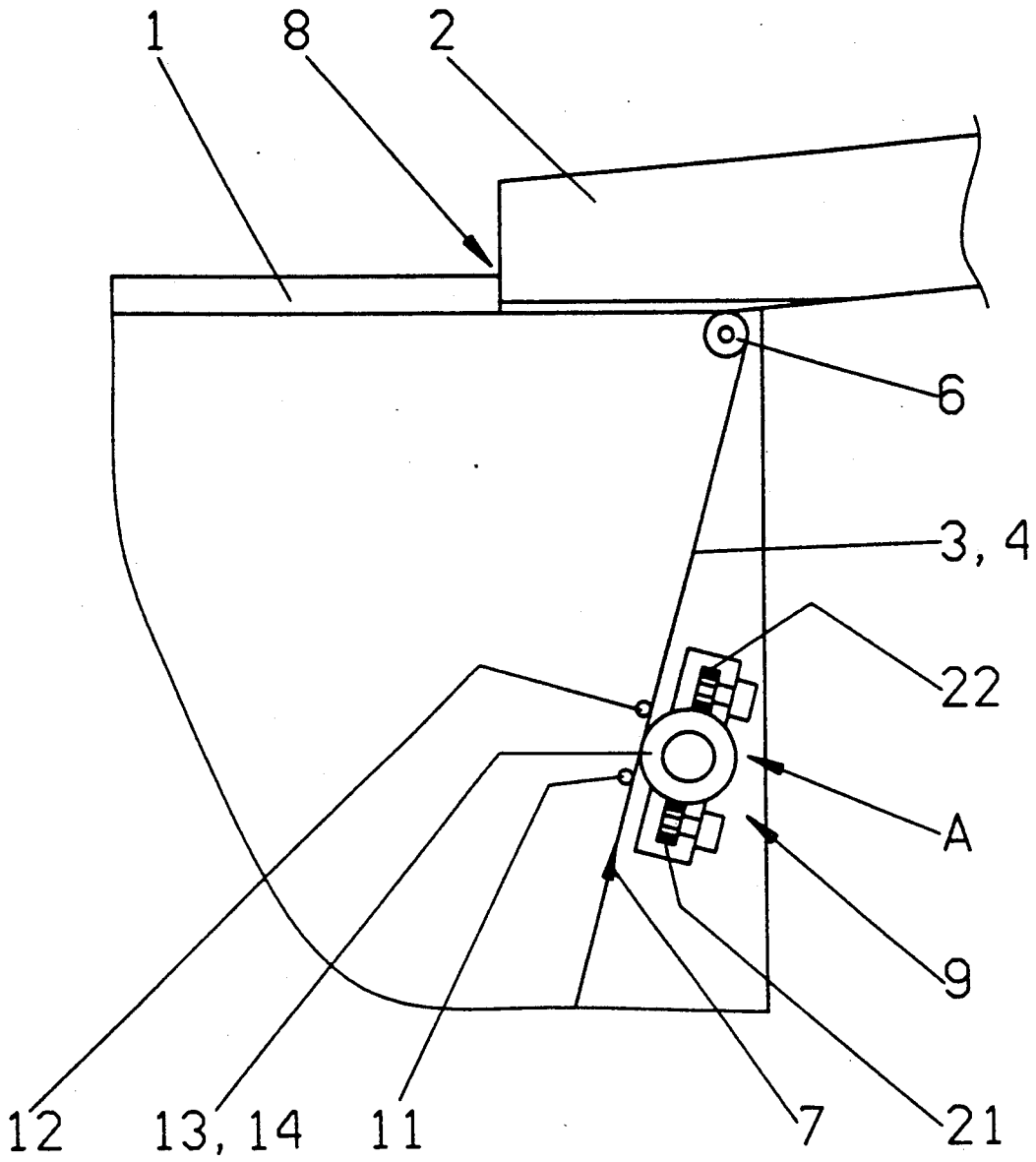
FIG. 1 is a fragmentary schematic front elevational view of a twin cigarette rod making machine which is equipped with an adhesive applying apparatus embodying the present invention.

FIG. 1 shows a portion of a twin cigarette rod making machine having a wrapping mechanism 1 (also called format) and one or two endless foraminous belt conveyors 2 (only one shown) which serve to deliver into the inlet 8 of the wrapping mechanism 1 two discrete continuous tobacco rods for draping into continuous webs 3, 4 of cigarette paper or other suitable wrapping material. The webs 3, 4 are drawn by one or more belt conveyors (called garnitures) which form part of the wrapping mechanism 1 and serve to drape the webs around the respective tobacco rods and to thus form two continuous cigarette rods. The cigarette rods are ready to be severed in discrete severing units, known as cutoffs, to yield plain cigarettes of unit length or multiple unit length. Reference may be had, for example, to commonly owned U.S. Pat. No. 4,889,138 granted Dec. 26, 1989 to Heitmann et al. for "Method of and apparatus for simultaneously making plural tobacco streams". This patent shows two endless foraminous belt conveyors which build and transport two discrete tobacco streams. Commonly owned U.S. Pat. No. 4,893,640, granted Jan. 16, 1990 to Heitmann et al. for "Multiple-rod cigarette making machine", shows a wrapping mechanism, two foraminous conveyors which deliver discrete tobacco rods to the wrapping mechanism, and two webs of cigarette paper which are processed in the wrapping mechanism so that each converted web forms a tube which sealingly surrounds the respective tobacco rod. Commonly owned U.S. Pat. No. 4,924,885 granted May 15, 1990 to Heitmann et al. for "Method of and apparatus for building, guiding and trimming streams of fibrous material" discloses several foraminous belt conveyors and devices which are used to trim the streams of fibrous material on the respective conveyors while the streams advance toward a wrapping mechanism. The disclosures of the above-enumerated patents are incorporated herein by reference.

The webs 3, 4 are drawn from a common reel or from two discrete reels, not shown, to advance along an elongated path in the direction of arrow 7 around a deflecting roll 6 which may but need not be driven and serves to direct the webs into the wrapping mechanism 1.

The improved adhesive applying apparatus or paster is installed at a level below the deflecting roll 6, i.e., at a level below the inlet 8 of the wrapping mechanism 1. This greatly reduces the likelihood of contamination of the mechanism 1 by droplets or sprays of adhesive paste which is being applied to one marginal portion of each of the two webs 3, 4 while such webs advance along a predetermined portion of their elongated path. The paster comprises a set 9 (i.e., a plurality) of rotary elements including two coaxial disc- or wheel-shaped applicators 13, 14 and two rotary disc- or wheel-shaped adhesive supplying members 21, 22 (see also FIG. 2). Those portions of the webs 3 and 4 which advance along the aforementioned predetermined portion of their path are propped by a pair of pins or rollers 11, 12 which are located opposite the applicators 13, 14.

Figure 2:
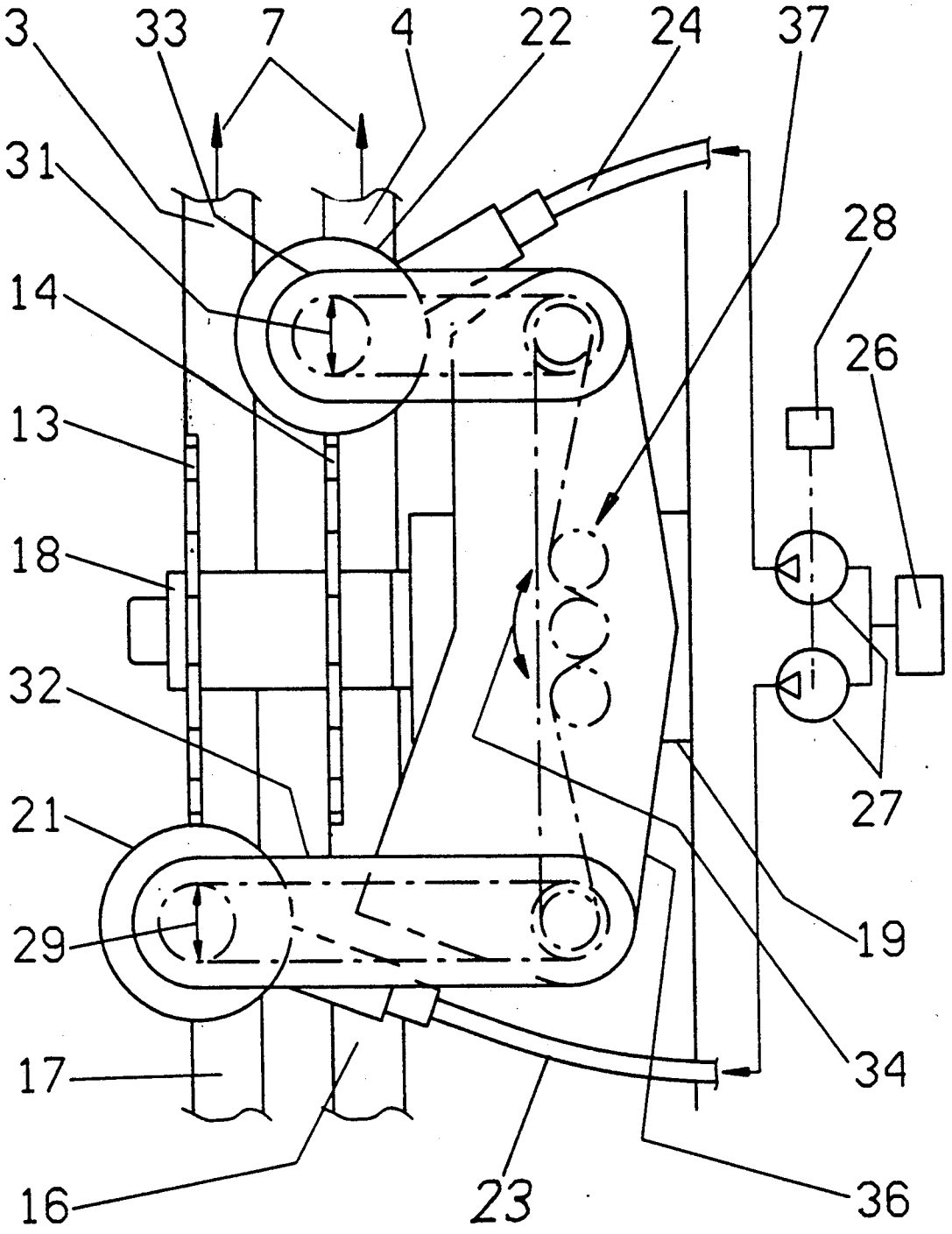
FIG. 2 is a greatly enlarged view of the adhesive applying apparatus, substantially as seen in the direction of arrow A in FIG. 1.

FIG. 2 shows that the peripheral surface of the applicator 13 contacts the left-hand marginal portion 17 at one side of the web 3 (namely that marginal portion which is remote from the web 4), and that the applicator 14 contacts the left-hand marginal portion 16 at one side of the web 4, namely that marginal portion which is adjacent the right hand marginal portion of the web 3. It is equally within the purview of the invention to shift the applicators 13, 14 in a direction to the right so that they apply adhesive paste to the right-hand marginal portions of the webs 3, 4; to move the applicators 13, 14 further apart so that the applicator 13 contacts the left-hand marginal portion 17 of the web 3 but the applicator 14 contacts the right-hand marginal portion of the web 4; or to move the applicators nearer to each other so that the applicator 14 continues to contact the left-hand marginal portion 16 of the web 4 but the applicator 13 contacts the right-hand marginal portion of the web 3. This depends upon the design of the wrapping mechanism 1.

The applicators 13, 14 are rotatable about a common axis which is defined by a shaft 18, and they can receive torque from a common drive 19.

The adhesive supplying member 21 has a concave peripheral surface which serves to deliver adhesive paste to the peripheral surface of the applicator 13, and the adhesive applying member 22 has a concave peripheral surface which serves to deliver adhesive to the peripheral surface of the applicator 14. The means for feeding adhesive paste to the concave surfaces of the members 21, 22 includes a tandem pump 27 which is driven by a motor 28 or another suitable prime mover and delivers adhesive paste to two hoses 23, 24 having their discharge ends adjacent the peripheral surfaces of the members 21, 22, respectively. The source of adhesive paste is a reservoir 26 which admits adhesive paste to the inlet of the tandem pump 27 when the motor 28 is on.

The adhesive supplying members 21, 22 are adjustable in directions indicated by double-headed arrows 29, 31, respectively. This is desirable and advantageous in order to rapidly convert the paster for the purpose of changing the format. To this end, the members 21, 22 are respectively mounted on levers 32, 33 which are pivotable in directions indicated by the arrows 29 and 31, respectively. A common carrier 36 for the levers 32, 33 is pivotable in directions indicated by a double-headed arrow 34, again for the purpose of conforming to the selected format.

The reference character 37 denotes a belt or chain transmission which serves to drive the rotary adhesive supplying members 21, 22 in synchronism.

The members 21, 22 are located substantially diametrically opposite each other with reference to the common axis of the applicators 13, 14.

The operation is as follows:

The aforementioned roll 6 and/or the garniture(s) continuously advances the webs 3, 4 in the direction of arrow 7 so that successive increments of these webs advance along the predetermined path portion at the propping members 11, 12 to extend substantially tangentially of the respective applicators 13 and 14. At such time, the web portions which contact the applicators are flat (see FIG. 2), and the applicators 13, 14 contact the marginal portions 17, 16 of the respective webs. The webs 3, 4 are parallel to each other.

The peripheral surfaces of the applicators 13, 14 continuously receive adhesive paste from the peripheral surfaces of the respective adhesive supplying members 21, 22 which, in turn, receive paste from the pump 27 through the respective conduits 23, 24. The coated webs 3 and 4 continue to advance toward the inlet 8 of and enter the wrapping mechanism 1 where they are draped around the respective tobacco rods. The last step involves the folding of adhesive-coated marginal portions 17, 16 over the other marginal portions of the respective webs 3 and 4 so that each of these webs is converted into a tube which surrounds the corresponding tobacco rod and forms therewith a continuous cigarette rod. The thus obtained seams are thereupon heated or cooled, depending on the nature of selected adhesive, and the rods are ready for subdivision into plain cigarettes of unit length or multiple unit length.

The improved adhesive applying apparatus can operate with a single applicator (13 or 14) to supply adhesive paste to the selected marginal portion of a single running web of cigarette paper, imitation cork, tipping paper or other suitable wrapping material. However, the illustrated apparatus can be used with particular advantage in twin cigarette rod making, filter rod making or analogous machines of the tobacco processing industry because it occupies a small amount of space and can be readily installed adjacent a selected portion of the path of one or more webs of wrapping material toward the inlet of the wrapping mechanism. The area at the wrapping mechanism or format of a twin cigarette rod making or like machine is invariably crowded so that savings in space are very important and desirable. The improved adhesive applying apparatus with two rotary coaxial disc-shaped applicators 13, 14 and two relatively small adhesive supplying rotary members 21, 22 is sufficiently compact to find room adjacent to the wrapping mechanism in a twin cigarette rod making or filter rod making machine.

If the webs 3 and 4 are obtained by dividing a wider web upstream of the propping members 11, 12, each of the applicators 13 and 14 contacts a discrete running web (this is actually shown in FIG. 2). However, if a relatively wide web is split (to yield two webs 3, 4) not too far away from the inlet 8 of the wrapping mechanism, the applicators 13, 14 can be used to apply strips of adhesive paste to two spaced-apart portions of the wide web, i.e., before the wide web is split to yield a plurality of narrower webs. In many instances, a relatively wide web is caused to advance through or past an imprinting mechanism prior to being split into narrower webs. The imprinting mechanism can apply the name, the brand name and/or the trademark of the manufacturer and/or other information.

The provision of a relatively small adhesive supplying member (21, 22) for each applicator contributes to compactness of the improved adhesive applying apparatus, the same as the provision of a tandem pump 27 which feeds adhesive paste to the members 21, 22.

An important advantage of the improved apparatus is its compactness so that it can find room in existing rod making machines of the tobacco processing industry. In fact, in spite of its limitations, the space which is available in a twin cigarette rod maker or a like machine at the wrapping station is amply sufficient to accommodate the improved apparatus or any practical modification of such apparatus.

Another important advantage of the improved apparatus is that the spraying of droplets of adhesive (if any) can be readily confined, at least to the extent that the adhesive cannot contaminate and eventually affect the operation of the wrapping mechanism 1.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for applying adhesive to wrapping material in a machine comprising a wrapping mechanism including means for draping wrapping material around at least one rod-shaped product of the tobacco processing industry; means for advancing wrapping material in the form of at least one web along a predetermined path toward the wrapping mechanism; a source of adhesive; and means for transferring adhesive from said source to the wrapping material in a predetermined portion of said path adjacent the wrapping mechanism, said transferring means comprising a plurality of rotary adhesive transferring elements and said elements including two coaxial disc-shaped applicators which contact two spaced-apart portions of the wrapping material in said portion of said path, a discrete mobile adhesive applying member for each of said applicators and means for feeding adhesive from said source to said members, said members being disposed at opposite sides of the common axis of said applicators.

2. The apparatus of claim 1 for applying adhesive to a single web of wrapping material, wherein said applicators contact two spaced-apart parallel portions at one side of the single web.

3. The apparatus of claim 1 for applying adhesive to two parallel webs of wrapping material, wherein each of said applicators contacts one of said parallel webs.

4. The apparatus of claim 3, wherein each of said webs has a first marginal portion adjacent the other web and a second marginal portion remote from the other web, one of said applicators contacting the first marginal portion of the respective web and the other of said applicators contacting the second marginal portion of the respective web.

5. The apparatus of claim 3, wherein said webs are coplanar in said portion of said path and are substantially tangential to the respective applicators.

6. The apparatus of claim 1, wherein said feeding means comprises a tandem pump.

7. The apparatus of claim 1, further comprising means for rotating said members.

8. The apparatus of claim 7, wherein said rotating means comprises a common drive for said members.

9. The apparatus of claim 1, further comprising means for rotating said applicators.

10. The apparatus of claim 9, wherein said rotating means comprises a common drive for said applicators.

* * * * *